United States Patent [19]

Imamura et al.

[11] 4,287,802

[45] Sep. 8, 1981

[54] ELECTRONIC MUSICAL INSTRUMENT OF TIME DIVISION MULTIPLEXED TYPE

[75] Inventors: Akio Imamura; Naota Katada, both of Hamamatsu, Japan

[73] Assignee: Nippon Gakki Seizo Kabushiki Kaisha, Hamamatsu, Japan

[21] Appl. No.: 40,041

[22] Filed: May 17, 1979

[30] Foreign Application Priority Data

May 19, 1978 [JP] Japan ..... 53-60405

[51] Int. Cl.[3] ..... G10H 1/22; G10H 5/00

[52] U.S. Cl. ..... 84/1.01; 84/DIG. 2; 84/DIG. 23

[58] Field of Search ..... 84/1.01, 1.03, DIG. 2, 84/DIG. 22, DIG. 23, DIG. 20

[56] References Cited

U.S. PATENT DOCUMENTS 4,122,744 10/1978 Uetrecht ..... 84/DIG. 2

*Primary Examiner*—Stanley J. Witkowski

*Attorney, Agent, or Firm*—Spensley, Horn, Jubas & Lubitz

[57] ABSTRACT

An electronic musical instrument having its keyboard divided into plural key ranges with musical tones being generated with tone colors which are different one key range from another. For achieving this object, the instrument comprises channel processors, tone generators, additional tone generators for the lowest (or highest) key in each key range, a common key coder for obtaining key data of depressed keys and a control circuit for supplying key codes delivered out of the key coder to only a channel processor of a corresponding key range. The key coder delivers out key data of depressed keys sequentially one key data at one time slot. According to the invention, the lowest (or highest) tone in a predetermined key range is generated with a tone color corresponding to the key range and also with a different tone color. The time slot allotted to the lowest (or highest) key is divided into two halves and a key code of the lowest (or highest) key is applied to a corresponding channel processor during the first half and is applied to a tone generator for the lowest (or highest) key after being once stored in a register. A lowest key detection circuit generates a pulse defining the second half of the time slot.

9 Claims, 6 Drawing Figures

ELECTRONIC MUSICAL INSTRUMENT OF TIME DIVISION MULTIPLEXED TYPE

BACKGROUND AND SUMMARY OF THE INVENTION

This invention relates to an improvement of an electronic musical instrument of a time division multiplexed type, in which the keyboard of a single keyboard type electronic musical instrument is divided into a plurality of key ranges, different tone colors are employed for different key ranges, and the lowest (or highest) tone in a predetermined key range is generated with a different tone color.

There is a prior art electronic musical instrument in which single keyboard is divided into plural key ranges, and the lowest (or highest) tone in the predetermined key range is generated with a different tone color. This prior art electronic musical instrument is so designed that analog tone signals corresponding to individual key switches are selected by means of the switches, and a particular preference circuit is provided to select the lowest (or highest) tone. Accordingly, it is necessary to additionally provide key switches in correspondence to the preference circuit, beside the normally used key switches. Thus, the prior art electronic musical instrument is disadvantageous in that the number of key switches is increased, and, accordingly, the wiring between the key switches and the relevant electrical circuits becomes necessarily intricate. In addition, in the prior art electronic musical instrument, the analog tone signals are directly selected by the key switches, as was described above. Therefore, the technical concept of the prior art electronic musical instrument cannot be applied directly to a digital process type electronic musical instrument.

Accordingly, an object of this invention is to eliminate all of the above-described difficulties accompanying the prior art electronic musical instrument.

More specifically, an object of the invention is to provide an electronic musical instrument, in which, unlike the prior art electronic musical instrument, there are provided key switches for preferentially selecting the lowest tone (or highest tone) and ordinary key switches thereby including two key switch arrays, but instead merely by using one key switch array it is possible not only to ordinarily generate musical tones according to key operations but also to generate the lowest (or highest) tone with a different tone color.

It is another object of the invention to provide an electronic musical instrument in which no special key switch array is required for detecting the lowest or highest note, whereby key switch wirings can be saved and an integral circuit design can readily be introduced.

This invention can be effectively applied to an electronic musical instrument of a type in which key depression is detected in a key switch array to provide key depression data (which is representative of a key depressed), and according to the key depression data musical tone signals are produced. A process for key range division is carried out by using digital key depression data obtained from a key depression detection circuit called "a key coder" or "a key code data generating unit". The purpose of the "key range division" is that, as was described before, a single keyboard is divided into a plurality of key ranges, and tones in different key ranges are produced with different tone colors, as if an electronic musical instrument having a plurality of keyboards were played. The key ranges have tone generators, respectively, and the tone generators of the key ranges can carry out their own tone color formation. Therefore, it is possible to provide different tone colors for different key ranges. In the process for key range division, a key range to which a key concerning key depression data belongs is discriminated, so that the key depression data is effectively used in the tone generator of the key range.

In this invention, with respect to a predetermined key range tones of the depressed keys, in the key range are generated with a common tone color by the tone generator of that key range, and the lowest (or highest) key depression tone is generated with a tone color different from the common tone color. The merit of this is that, besides the effect of the key range division, an effect obtainable from provision of an additional keyboard for monophonic performance is produced. It can be readily understood that the key depression data of the lowest (or highest) tone in the key range is utilized in both the tone generator of the key range and the tone generator for the monophonic performance. For this purpose, in the prior art electronic musical instrument, two key switch arrays, i.e., the ordinary key switch array and the key switch array for preferencially selecting the lowest (or highest) tone are provided. This point is improved according to the invention. That is, one of the specific features of the invention resides in that, among time slots allotted for key depression data delivered out in succession according to the detection scanning of one key switch array, a time slot for the key depression data of the lowest (or highest) tone in the predetermined key range is divided into two portions, i.e. a first half and a second half, and during the first (or second) half of the time slot, the key depression data is processed for forming a musical tones with a common tone color in the key range, whereas during the second (or first) half the key depression data is processed for forming a musical tone with a tone color different from the common tone color.

It is considerably effective for the detection of the lowest (or highest) tone to carry out the scanning of the key switch array in the order of increasing (or decreasing) tone pitches. If this method is employed, key depression data delivered out first in one scanning cycle can be regarded automatically as that of the lowest (or highest) tone. Therefore, it is unnecessary to provide an intricate circuit such as the lowest (or highest) tone detection circuit; that is, the lowest (or highest) tone can be detected by using a simple circuit (such as a circuit for detecting the rise of a digital signal).

DETAILED DESCRIPTION OF THE INVENTION

In one embodiment of this invention, a single keyboard is divided into two ranges, namely, higher key range and a lower key range. The higher key range is used for tone coloring of a melody performance keyboard (corresponding to the upper keyboard of a plural keyboard type electronic musical instrument), while the lower key range is used for tone coloring of an accompaniment keyboard (corresponding to the lower keyboard of the plural keyboard type electronic musical instrument), and the lowest tone in the lower key range is produced with a bass tone color.

Figure 1:
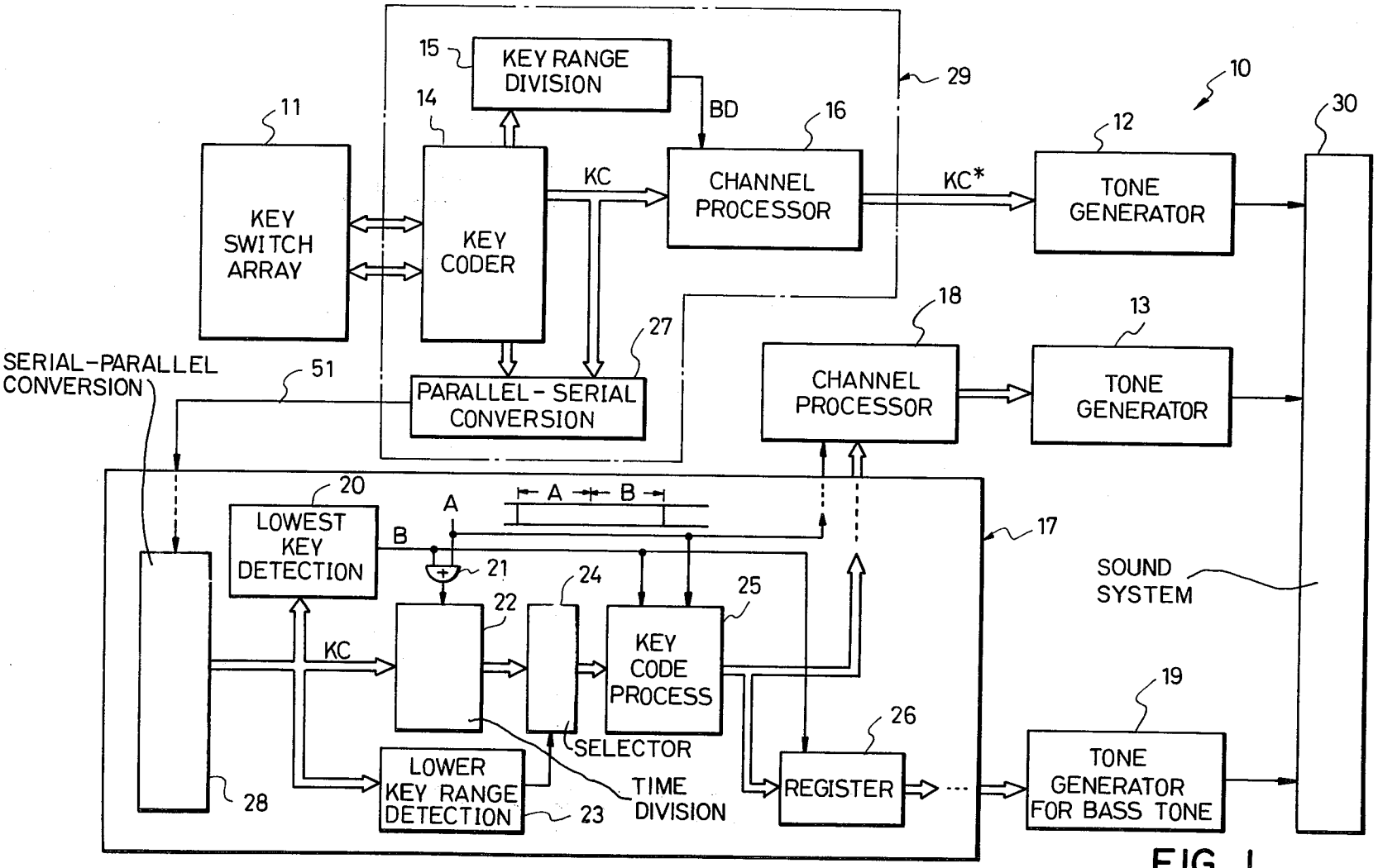
FIG. 1 is a block diagram showing one example of an electronic musical instrument according to this invention.
Figure 2:
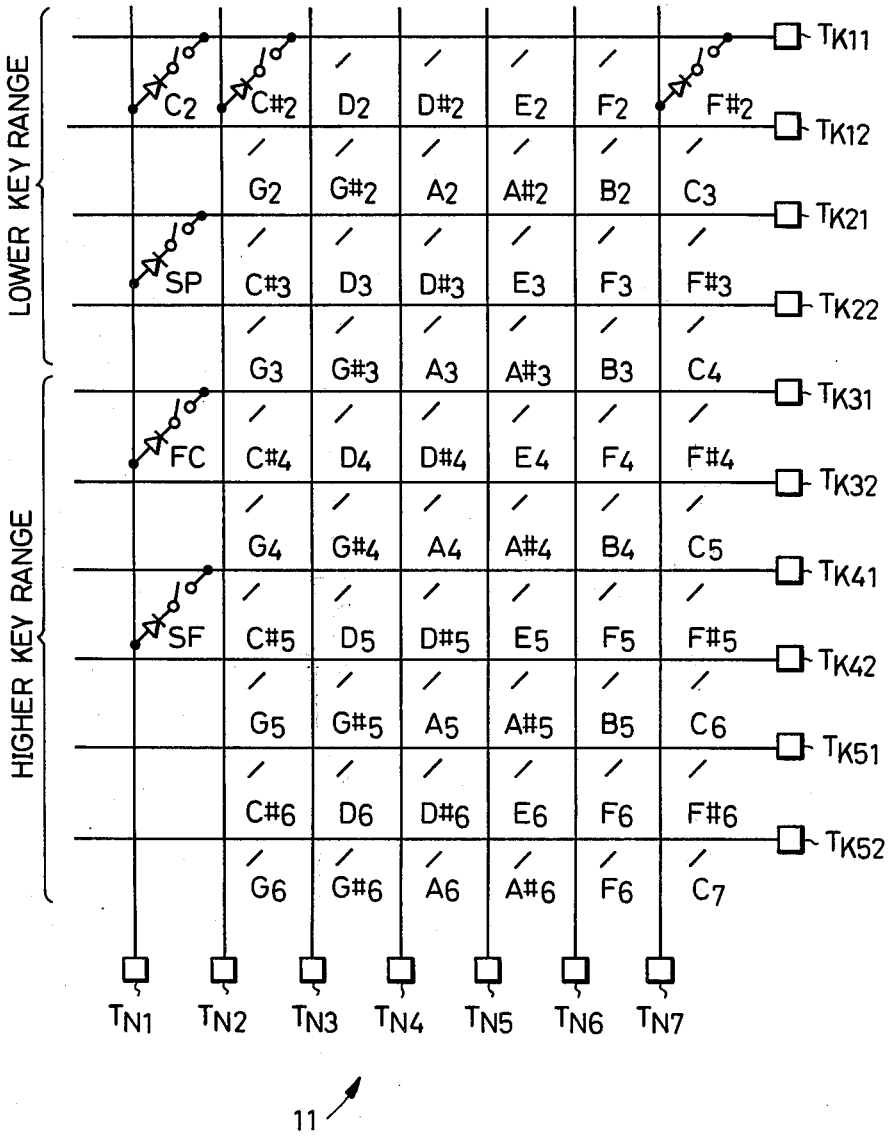
FIG. 2 is an explanatory diagram showing a key switch array in FIG. 1.

An electronic musical instrument according to this invention shown in FIG. 1 is of a single keyboard type. A key switch array 11 in the single keyboard is such that the key switches of the keys are arranged in a matrix fashion. FIG. 2 shows one example of the key switch arrangement 11. The whole key range of the keyboard is from C2 through C7, and performance effect selecting switches SP, FC and SF in addition to ordinary key switches are included in the key switch array 11.

Referring to FIG. 2, six column writing corresponding to column terminals $TN_2$ through $TN_7$ among column terminals $TN_1$ through $TN_7$ correspond to notes C# through F# or G through C respectively. On the other hand, row terminals $Tk_{11}$–$Tk_{52}$ correspond to half octaves, respectively. More specifically, the row terminal $Tk_{11}$ corresponds to the half octave on the lowest tone side, and the line terminal $Tk_{52}$ corresponds to the half octave on the highest tone side.

The wiring of the remaining column terminal $TN_1$ is utilized by the lowest note C2 and the performance effect selecting switches SP, FC and SF. The key switch of note C2 is arranged at the intersection of the terminals $Tk_{11}$ and $TN_1$. The switch SP is arranged at the intersection of the terminals $Tk_{21}$ and $TN_1$, the switch FC is arranged at the intersection of the terminals $Tk_{31}$ and $TN_1$, and the switch SF is arranged at the intersection of the terminals $Tk_{41}$ and $TN_1$.

The switch SP is a key range division mode selecting switch. When the switch SP is switched on, the electronic musical instrument 10 operates in the key range division mode. In the key range division mode, the keyboard is divided into the lower key range and the higher key range between notes C4 and C#4, and the tones in the two key ranges are produced with different tone colors.

Referring back to FIG. 1, in the electronic musical instrument 10, main tone generator unit 12 is used to produce the musical tones in the higher key range (key names C#4 through C7). This main tone generator unit 12 has musical tone forming functions (including a tone color forming function and a tone color selecting function) which are equal to or similar to those of a musical tone generating circuit provided for the melody performance keyboard or the upper keyboard in the ordinary plural-keyboard type electronic musical instrument. That is, the main tone generator may be arranged similarly as in musical tone generating circuits disclosed in, for instance, the specification of U.S. patent application Ser. No. 968,860, filed Dec. 12, 1978 and assigned to the same assignee as the present case, and U.S. Pat. Nos. 3,882,751 and 4,082,027.

An auxiliary tone generator unit 13 is used to produce the musical tones in the lower key range (key names C2 through C4). The auxiliary tone generator unit 13 has musical tone forming functions (including a tone color forming function and a tone color selecting function) which are equal to or similar to those of a musical tone generating circuit provided for the accompaniment keyboard or the lower keyboard in the plural-keyboard type electronic musical instrument.

When the switch SP is switched off, the electronic musical instrument 10 does not operate in the key range division mode, that is, it operates as an ordinary single keyboard type electronic musical instrument. In this case, the musical tones in the whole key range (C2 through C7) are produced by the main tone generator unit 12.

The switches FC and SF are operated in the case where a finger chord function (FC) and a single finger function (SF) in an automatic bass chord performance are selected, respectively. However, since these switches are not directly related to this invention, detailed description of them will be omitted.

The column terminals $TN_1$ through $TN_7$ and the row terminals $Tk_{11}$ through $Tk_{52}$ in the key switch arrangement 11 are connected to a key coder 14 (FIG. 1). The key coder 14 receives signals from the key switch arrangement 11 and transmit signals to the key switch arrangement 11, so that scanning is carried out for key depression detection beginning with a key on the lowest tone side. As a result of the scanning, digital code data (key code KC) consisting of a plurality of bits for identifying the key name is provided for the key which has been detected as depressed. Each key code KC consists of a note code $N_1$–$N_4$ consisting of four bits representative of a note, and a block code $B_1$–$B_3$ consisting of three bits representative of an octave range. The key codes KC are as indicated in Table 1 below.

TABLE 1

| | KC | $B_3$ | $B_2$ | $B_1$ | $N_4$ | $N_3$ | $N_2$ | $N_1$ |
|---|---|---|---|---|---|---|---|---|
| | $C_2$ | 0 | 0 | 0 | 1 | 1 | 1 | 1 |
| Octave | C#2-C3 | 0 | 0 | 1 | | | | |
| | C#3-C4 | 0 | 1 | 0 | | | | |
| | C#4-C5 | 0 | 1 | 1 | | | | |
| | C#5-C6 | 1 | 0 | 0 | | | | |
| | C#6-C7 | 1 | 0 | 1 | | | | |
| Note | C# | | | | 0 | 0 | 0 | 1 |
| | D | | | | 0 | 0 | 1 | 0 |
| | D# | | | | 0 | 0 | 1 | 1 |
| | E | | | | 0 | 1 | 0 | 1 |
| | F | | | | 0 | 1 | 1 | 0 |
| | F# | | | | 0 | 1 | 1 | 1 |
| | G | | | | 1 | 0 | 0 | 1 |
| G# | | | | 1 | 0 | 1 | 0 | |
| A | | | | 1 | 0 | 1 | 1 | |
| | A# | | | | 1 | 1 | 0 | 1 |
| | B | | | | 1 | 1 | 1 | 0 |
| | C | | | | 1 | 1 | 1 | 1 |

The key codes KC of plural keys are not provided simultaneously by the key coder 14; that is, individual key codes are outputted one after another at certain time intervals (or at suitable time intervals). A matrix key switch scanning circuit known in the art may be used as the key coder 14; however, it is preferable that a system disclosed in the specification of U.S. patent application Ser. No. 940,381 filed Sept. 7, 1978 and assigned to the same assignee as the present case, is employed. In the key coder proposed by the above-described U.S. patent application, the key codes of only the keys depressed are outputted in certain time slots, and no time slots are assigned to keys which are not depressed. Accordingly, the width of a time slot in which one key code is to be delivered out can be increased. This is convenient for the case where, in this invention, one time slot is divided into two parts.

In the key coder 14, the on-off operations of the performance effect switches SP, FC and SF are detected. A key range division circuit 15 is to cause the electronic musical instrument 10 to operate in a key range division mode when the on state of the switch SP is detected in the key coder 14. In the key range division mode, the key range division circuit 15 operates so that the key codes KC of the lower key range (C2 through C4) are not utilized by a main channel processor 16. More specifically, when a key code KC of the lower key range is supplied from the key coder 14 to the main channel processor 16, an assignment permission signal BD is set to "0", so that assignment of the lower key range key code KC to the main channel processor 16 is prohibited.

The main channel processor operates to assign depressed keys to a particular number of (for instance eight) tone production channels in the main tone generator unit 12. A conventional tone production assignment circuit may be employed as the main channel processor 16, or a circuit disclosed in the specification of U.S. Pat. No. 4,192,211 or U.S. Pat. No. 4,114,495 may be employed. In the main channel processor 16, a tone corresponding to a key code KC* assigned to a channel is produced in a relevant channel in the main tone generator 12.

Accordingly, in the key range division mode, by the operation of the key range division circuit 15 only the notes (keys) of the higher key range (C#4–C7) are assigned to the tone production channels of the main tone generator unit 12, but no notes (keys) of the lower key range (C2–C4) are assigned thereto.

The key codes KC of the lower key range are suitably processed in a processing circuit 17 provided for special performance functions, and are then supplied to an auxiliary channel processor 18. According to the assignment in the auxiliary channel processor 18, key-depressed notes in the lower key range are provided by the auxiliary tone generator.

In the processing circuit 17, the key code of the lowest note among the notes of the depressed keys in the lower key range is picked up, and is then applied to a tone generator 19 for a bass tone. A tone production circuit similar to that employed in the main channel processor 16 is used as the auxiliary channel processor 18.

The processing circuit 17 for provided for special performance function operates for "the key range division mode" or "an automatic bass chord performance". The processing circuit supplies tone information (key codes) concerning automatic chord tones to the auxiliary channel processor 18, and supplies tone information (key codes) concerning automatic bass tones to the tone generator 19 when the automatic bass chord performance is selected.

In the case where the key range division mode is selected, the processing circuit 17 permits the key code KC of a key depressed in the lower key range (C2 through C4) to pass as it is, and divides, in the time slot in which the key code KC of the lowest tone is supplied from the key coder 14, the time slot into two parts, so that the first half (or the second half) of the time slot is used for processing the key code of the lowest tone supplied to the auxiliary channel processor 18, while the second half (or the first half) is used for processing the key code of the lowest tone supplied to the tone generator 19.

The processing circuit 17 will be described in more detail with reference to its various circuits 20 to 26. A pulse A is provided in the first half of one time slot in which one key code KC is supplied, and the pulse A is applied through an OR circuit 21 to a time division circuit 22, so that the key code KC is selected to be outputted in the first half of the time slot. This key code KC is applied through a selector 24 to a key code processing circuit 25, where it is subjected to process required as a key code for accompaniment tone coloring or lower keyboard tone coloring (for instance the octave data is changed or given). A lower key range detection circuit 23 operates to detect whether or not a key code KC supplied by the key coder 14 is for the lower key range (C2 through C4). When it is for the lower key range, the lower key range detection circuit 23 renders the selector 24 conductive. Accordingly, a key code KC for the higher key range, which is utilized by the main channel processor 16 is blocked by the processing circuit 17, and therefore it is not utilized by the auxiliary channel processor 18 and by the bass tone generator 19.

The key code KC suitably processed as the key code for accompaniment tone coloring in the duration of the pulse A (in the first half of the time slot) is applied from the key code processing circuit 25 to the auxiliary channel processor 18. The pulse A is also supplied to the auxiliary channel processor 18. The key code KC supplied to the auxiliary channel processor 18 in synchronization with the pulse A is effectively utilized in the auxiliary channel processor 18.

The lowest tone detection circuit 20 operates to detect the provision of the key code of the lowest tone among the key codes of keys depressed in the lower key range, and to produce a pulse B in the second half of the time slot of the supply of the lowest tone key code. Alternatively, the detection circuit 20 may be so constructed that it will detect a plurality of key codes of specific keys including the key for the lowest tone. The pulse B is applied through the OR circuit to the time division circuit 22, so that the lowest tone key code KC is selected to be outputted in the second half of the time slot. The pulse B is further applied to the key code processing circuit 25, where it is subjected to process required as the base tone coloring key code. The lowest tone key code KC thus processed in held by a bass register 26. That is, the bass register 26 is placed in loading state with the aid of the pulse B, as a result of which the lowest tone key code KC to be used for bass tone coloring is held.

Thus, each lower key range key code KC to be produced with accompaniment tone color (or lower keyboard tone color) is suitably processed in the first half (or the second half) of the respective time slot, and is then applied to the auxiliary channel processor 18. In the auxiliary channel processor 18, tones corresponding to these lower key range key codes are assigned to the particular number of tone production channels in the auxiliary tone generator 13. As a result, the tones of the keys depressed in the lower key range (C2 through C4) are produced in the channels to which the key codes have been assigned as described above. The tone colors of the tones thus produced are the common tone color which has been set and selected in the auxiliary tone generator 13. On the other hand, the key code of the lowest tone suitably processed in the second half of the time slot is stored and held in to bass register 26, and is supplied to the tone generator 19. Accordingly, a tone corresponding to the lowest tone key code is produced with a bass tone color by the tone generator 19. It goes without saying that a tone corresponding to the lowest tone key code processed in the first half of the time slot is produced by the auxiliary tone generator 13.

The key codes KC and other data (such as for instance the detection data of the switch SP) outputted by the key coder 14 are converted into serial data by a parallel-to-serial conversion circuit 27, and are then supplied to the processing circuit 17. A serial-to-parallel conversion circuit 28 is provided in the processing circuit 17 to convert the serial data back to the parallel data. The reason for this resides in that, where the circuits including the key coder 14 surrounded by the one-dot chain line are formed as one chip, or an integrated circuit assembly, the number of pins can be reduced.

The key-depressed tones in the higher key range outputted with the melody tone color (or the upper keyboard tone color) by the main tone generator unit 12, the key-depressed tones in the lower key range outputted with the accompaniment tone color (or the lower keyboard tone color) by the auxiliary tone generator unit 13, and the lowest key-depressed tone generated with the bass tone color by the bass tone generator 19 are produced by a sound system 30.

The essential components of the electronic musical instrument according to the invention will be described.

Figure 3:
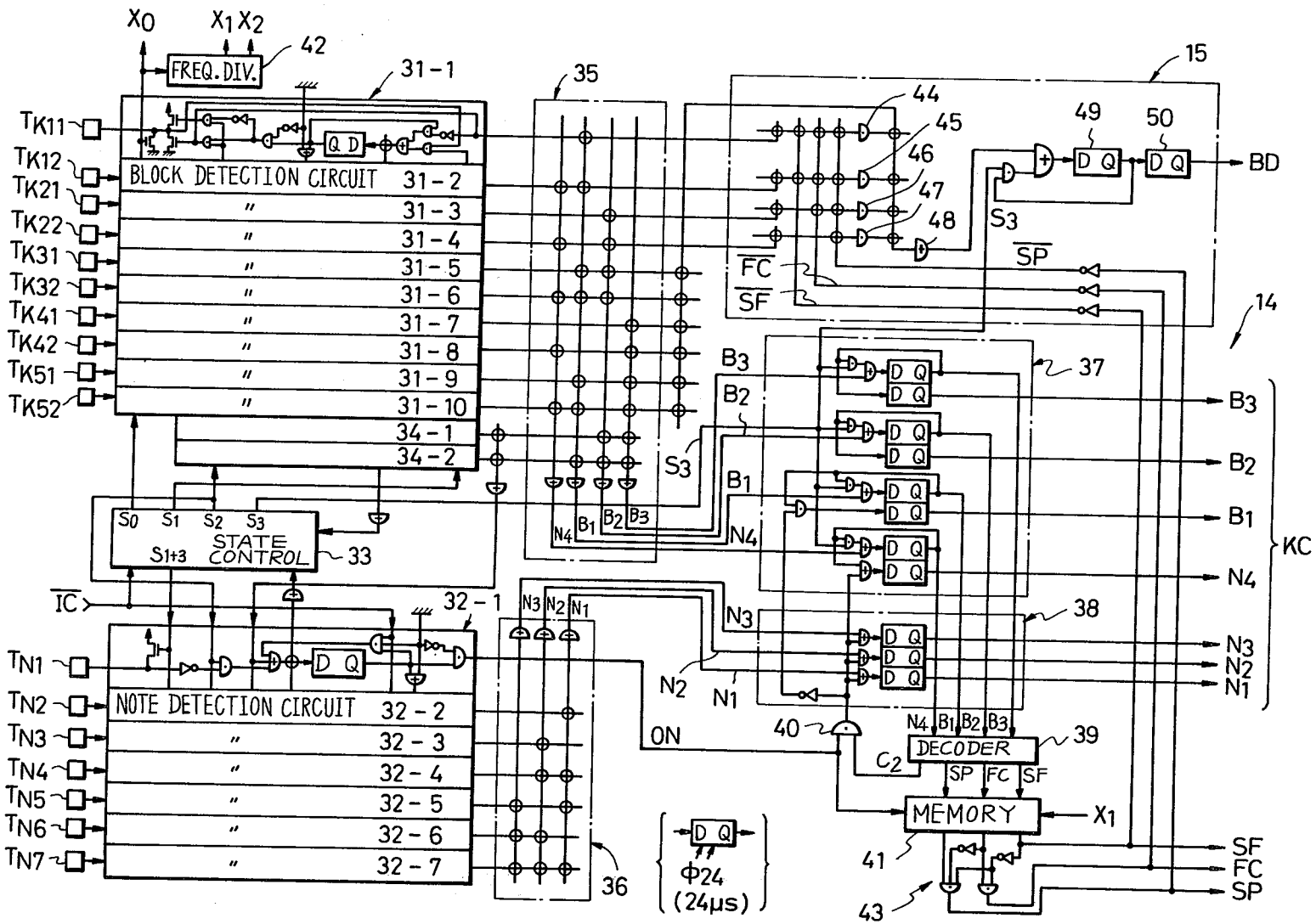
FIG. 3 is a circuit diagram, partly drawn as a clock diagram, showing one example of a key coder and one example of a key range division circuit shown in FIG. 1.

In FIG. 3, block detection circuits 31-1 through 31-10, note detection circuits 32-1 through 32-7, a state control circuit 33, and automatic bass chord processing circuits 34-1 and 34-2 in the key coder may be similar in arrangement to those described in the specification of U.S. patent application 940,381, or those described in the specification of U.S. Pat. No. 4,148,017. In a key coder or a key code data generating unit described in the aforementioned specifications, the wiring capacitance of a key switch array (11) is utilized so that signals are transmitted back and forth between block detections circuits (31-1 through 31-10) and note detection circuits (32-1 through 32-7). The key coder 14 in FIG. 3 also operates in the same manner.

The row terminals $Tk_{11}$ through $Tk_{52}$ of the key switch array 11 are connected to the block detection circuits 31-1 through 31-10, and the column terminals $TN_1$ through $TN_7$ are connected to the note detection circuits 32-1 through 32-7, respectively. These detection circuits 31-1 through 32-7 carry out predetermined operations according to states $S_0$, $S_1$, $S_2$ and $S_3$. The state control circuit 33 operates to control the switching of the states $S_0$ through $S_3$, and to output a signal representative of a current state.

The period of a clock pulse controlling the operation of the key coder 14 is, for instance, 24 $\mu$s, which corresponds to one time slot for delivering out one key code KC.

The states are changed in the order of $S_0 \rightarrow S_1 \rightarrow S_2 \rightarrow S_3$. The states $S_2$ and $S_3$ are repeated, and followed by the state $S_1$ as the case may be.

The state $S_0$ is to represent the start of a key depression detection scanning. In this state $S_0$, wiring capacitances corresponding to the row terminals $Tk_{11}$ through $Tk_{52}$ are discharged so that the preparation conditions are obtained.

In the state $S_1$, voltages are supplied in a parallel mode to the column terminals $TN_1$ through $TN_7$ from the side of the note detection circuits 32-1 through 32-7, so that key depression signals are stored in the block detection circuits 31-1 through 31-10 corresponding to the respective semioctave ranges in which keys are depressed.

In the state $S_2$, one block detection circuit is extracted out of the block detection circuits which have stored the key depression signals, thereby to detect the note of the depressed key in the semioctave range corresponding to the block detection circuit thus extracted. That is, the key depression signals are stored in the note detection circuit 32-1 through 32-7 corresponding to the key depression notes in the half octaves ranges. In extracting one out of the block detection circuits, the lowest block detection circuits takes precedence over the others; that is, the block detection circuits, 31-1, 31-2, . . . and 31-10 are extracted in the described order.

In the state $S_3$, according to the key depression storages of the note detection circuits 32-1 through 32-7, the key codes KC of the depressed keys in a relevent semioctave range are generated one at a time-slot successively beginning with the key code corresponding to the lowest tone. That is, the key depression storages of the note detection circuits 32-1 through 32-7 are extracted one at a time. This extracted note is encoded by a note encoder 36, so that the data of three least significant bits $N_3$, $N_2$ and $N_1$ of the note codes are obtained. Simultaneously, a block encoder 35 provides the code $B_3$, $B_2$, $B_1$, $N_4$ of a semi-octave range corresponding to the extracted block detection circuit.

Then, the state $S_2$ is effected again, so that the block detection circuit in the next order is extracted. Thereafter, the state $S_3$ is repeated with respect to depressed keys in a semi-octave range corresponding to that block detection circuit.

After all of the key codes KC of depressed keys in the key switch array 11 have been generated by repeating the states $S_2$ and $S_3$ this way, the first state $S_0$ is effected.

Figure 4:
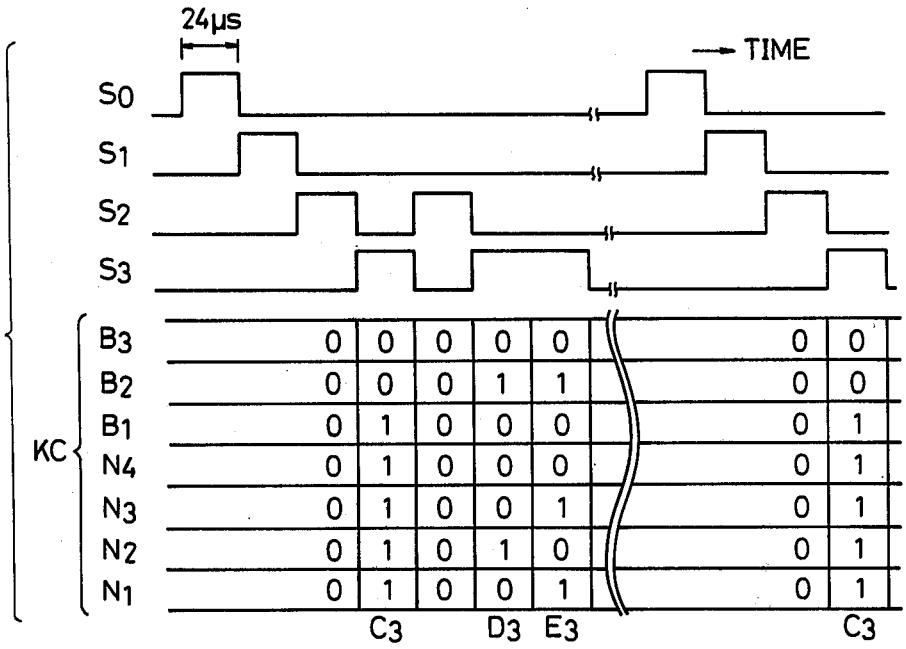
FIG. 4 is a timing chart for a description of the operation of the key coder in FIG. 3.

For instance, in the case where three keys $C_3$ $D_3$ and $E_3$ are depressed, the states $S_0$ through $S_4$ and the contents of the generated key codes KC are as shown in FIG. 4. In this case, the note $C_3$ corresponding to the key code (0 0 1 1 1 1 1) supplied first in the scanning cycle is the lowest key depression note.

The code $N_4$-$B_3$ outputted by the block encoder 35 is applied to a block register 37, where it is held for the state $S_3$. The code $N_1$-$N_3$ provided by the note encoder 36 is applied to a note register 38 which is a timing buffer. The block register 37 has circuits which perform self-holding with the aid of a signal representative of the state $S_3$.

The note register 37 does not carry out self-holding, but merely delay the code by one bit time (clock pulse $\phi_{24}$). In FIG. 3, reference character DQ designates a one-bit delay flip-flop.

A decoder 39 operates to decode the code $N_4$, $B_1$, $B_2$, $B_3$ applied thereto from the block register 37, thereby to obtain the key switch signal of note C2 or the operation signals of the performance function selecting switches SP, FC and SF. The relations between the input and output data of the decoder 39 are as indicated in Table 2 below.

TABLE 2

| | $B_3$ | $B_2$ | $B_1$ | $N_4$ |
|---|---|---|---|---|
| SP | 0 | 1 | 0 | 0 |

TABLE 2-continued

| | $B_3$ | $B_2$ | $B_1$ | $N_4$ | | |
|---|---|---|---|---|---|---|
| FC | 0 | 1 | 1 | 0 | | |
| SF | 1 | 0 | 0 | 0 | | |
| C2 | 0 | 0 | 1 | 0 | ..... | to be converted into 0001111 |

The outputs of the decoder 39 are effectively utilized only when the switch-on signal ON concerning the column terminal $TN_1$ is supplied from the note detection circuit 32-1. That is, when the decoder output of the note C2 is provided, the supply of the switch-on signal ON means that the key depression detection of the key switch of the note C2 has been carried out, and therefore the output C2 and the signal ON are applied to an AND circuit 40. With the aid of the switch-on signal ON, a memory 41 is placed in loading state to store the data SP, FC or SF.

When the key depression of the note C2 is detected, the output of the AND circuit 40 is raised to "1". By this output "1", the note Code $N_1$-$N_4$ is converted into "1 1 1 1" ub in the note register 38, while the block code $B_3$-$B_1$ is converted into "0 0 0" in the block register 37. The memory 41 operates to provide the outputs SP, FC and SF of the performance function selecting switch as DC signals (sustained signals); and is cleared by a signal $X_1$. The signal $X_1$ is obtained by subjecting a pulse $X_0$ synchronous with the state $S_0$ to suitable frequency division (for instance $\frac{1}{8}$ frequency division) in a frequency division circuit 42. The memory 41 is cleared with a period ($X_1$) longer than the scanning cycle (corresponding to the repetition of the state $S_0$) in order to eliminate the chattering of the switch (SP, FC or SF).

The output of the memory 41 is applied to a priority logic 43. The order of priority in the priority logic 43 is as SF→FC→SP, so that when the switches SP, FC and SF are operated simultaneously, one of them take precedence over the others.

The detection signals of the switches, SP, FC and SF passed through the priority logic 43 are applied to the key range division circuit, where they are inverted into negative signals $\overline{SP}$, $\overline{FC}$ and $\overline{SF}$, respectively, which are applied to AND circuits 44, 45, 46 and 47. These AND circuits 44 through 47 are provided in correspondence with four half-octave ranges on the lower tone side which correspond to the line terminals $Tk_{11}$, $Tk_{12}$, $Tk_{21}$ and $Tk_{22}$. The signal $\overline{SP}$ is applied to the AND circuits 44 through 47, the signal $\overline{FC}$ is applied to the AND circuits 44 through 46, and the signal $\overline{SF}$ is applied to the AND circuits 44 and 45. This is because, while in the key range division mode two octave ranges from C2 to C4 are the lower key range, in the finger chord function (FC) one and half octaves from C2 to F#3 are used as the automatic performance key range, and in the single finger function one octave from C2 to C3 is used as the automatic performance key range. These automatic performance functions will not be described in detail, because they are not directly concerned with the invention. The outputs of the block detection circuits 31-1 through 31-4 are applied to the remaining input terminals of the AND circuits 44 through 47.

The outputs of the AND circuits 44 through 47 are applied to an OR circuit 48. The outputs of the block detection circuits 31-5 through 31-10 corresponding to the higher key range (C#4–C7) in the key range division mode are applied to the remaining input terminals of the OR circuit 48. When the key depression detection of the higher key range (C#4–C7) is carried out, the output of the OR circuit 48 is at "1" at all times.

In the case where the key range division mode is selected, the signal $\overline{SP}$ is at "0", and therefore all of the AND circuits 44 through 47 are disabled. When the key depression detection of the lower key range (C2–C4) is carried out (when the outputs of the block detection circuits 31-1 through 31-4 are at "1"), the output of the OR circuit is set to "0". The output signal of the OR circuit 48 is held by the delay flip-flop 49 for the period of the state $S_3$, and it is applied, as an assignment permission signal BD, to the main channel processor 16 through a delay flip-flop 50.

Thus, in the case of the key range division mode, the assignment permission signal BD is set to "1" in synchronization with the time slot in which a key code ($N_1$-$B_3$) representative a key depressed in the higher key range (C#4–C7) is delivered out by the block register 37 and the note register 38, so that the main channel processor 16 is permitted to carry out the assignment of the higher key range key code KC. On the other hand, in synchronization with the time slot in which a key code KC for the lower key range is delivered out, the signal BD is set to "0", so that the key code KC is not assigned by the main channel processor 16.

A key code KC ($N_1$-$N_4$, $B_1$-$B_3$) supplied by the block register 37 and the note register 38 is supplied to the main channel processor 16 and to the parallel-serial conversion circuit 27 (FIG. 1). The performance function selection signal SP, FC and SF provided through the priority circuit 43 by the memory 41, and the signals $X_0$ and $X_1$ representative of the key depression detection cycles are also applied to the parallel-serial conversion circuit 27.

In the parallel-serial conversion circuit 27, one set of data $N_1$-$N_4$, $B_1$-$B_3$, SP, FC, SF, $X_0$, and $X_1$ supplied thereto in one time slot (24 μs) are delivered out in a serial mode to one line 51 (FIG. 1). For instance, a parallel-input serial-shift type 24-bit shift register may be employed as the conversion circuit 27. This shift register is driven by the clock pulse $\phi_1$ of one microsecond, so that the serial delivery of the above-described data $N_1$ through $X_1$ is achieved in one delivery time slot (24 μs) of the key code KC.

In the special performance function processing circuit 17 (FIG. 1), serial data supplied thereto through the line 51 are converted into parallel data by a serial-parallel conversion circuit 28. The conversion circuit 28 is, for instance, a serial-input serial-shift parallel-output type 24-bit shift register which is driven by the clock pulse $\phi_1$ of one microsecond. The serial-parallel conversion circuit 28 includes latch circuit means, so that when one set of data $N_1$-$N_4$, $B_1$-$B_3$, SP, FC, SF, $X_0$ and $X_1$ are obtained, these data are latched for one time slot (24 μs). This is equivalent to the fact that the outputs of the key coder 14 are supplied, as they are, to the processing circuit 17.

The essential circuits of the processing circuit 17 will be described with reference to FIG. 5.

A latch circuit 52 is included in the above-described serial-parallel conversion circuit 28. The latch contents of the latch circuit 52 is rewritten with the aid of a latch timing pulse Sy shown in the part (a) of FIG. 6, every 24 μs. Accordingly, one set of data $N_1$-$N_4$, $B_1$-$B_3$, SP, FC, SF, $X_0$ and $X_1$ outputted in a parallel mode by the latch circuit 52 has the time width of 24 us as shown in the part (b) of FIG. 6. A signal A having a period of 24 us and a duty of $\frac{1}{2}$ is produced in synchronization with the first half period (12 μs) of the time slot of 24 μs as shown in the part (c) of FIG. 6. This signal A is produced by a timing signal generating circuit (not shown). A clock pulse $\phi_{12}$ (two-phase clock pulse) having a period of 12 us is also generated by the timing signal generating circuit as shown in part (d) of FIG. 6.

Figure 5:
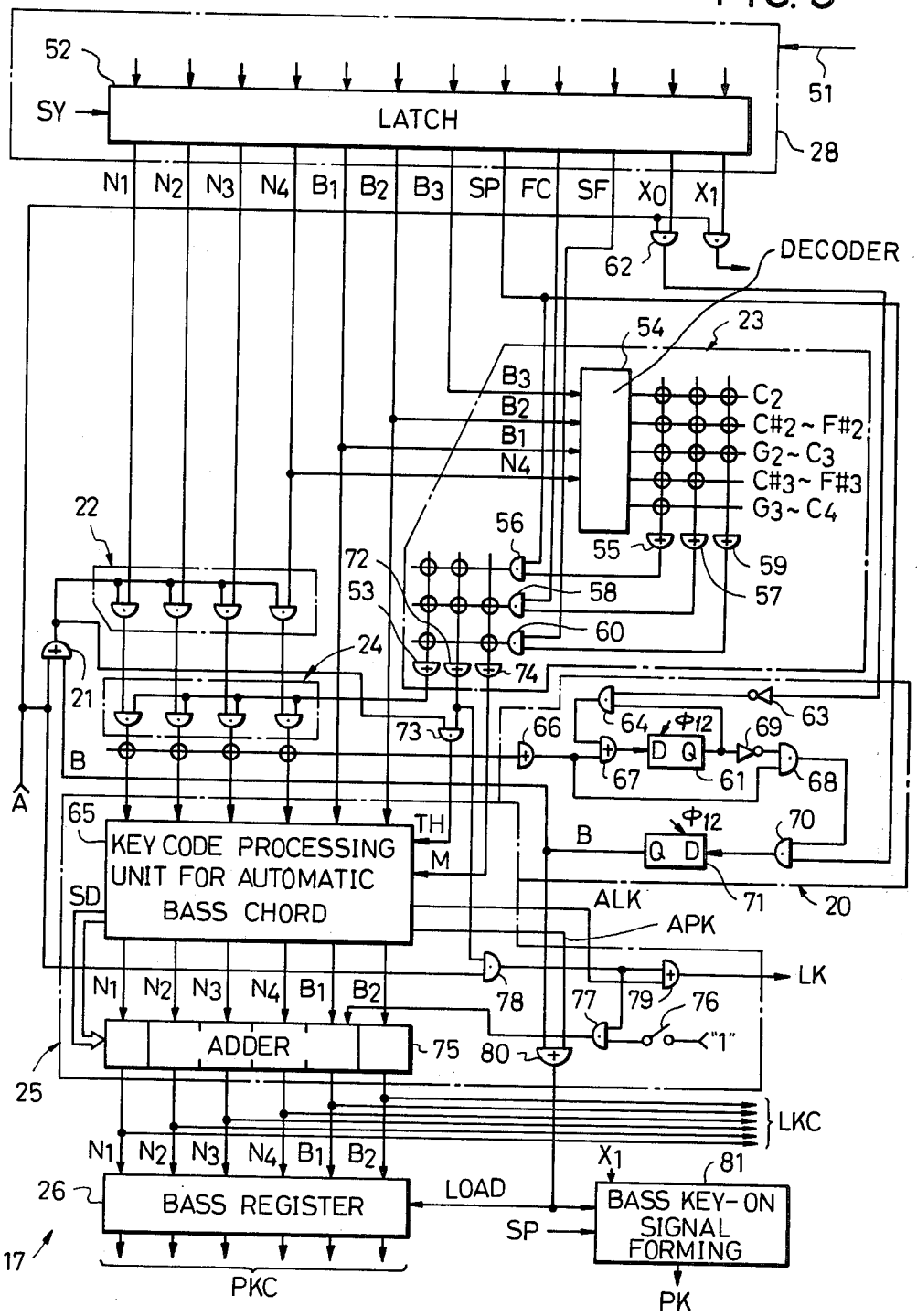
FIG. 5 is a circuit diagram, partly drawn as a block diagram, showing one example of a processing circuit for special functions shown in FIG. 1.

In FIG. 5, the time division circuit 22 is made up of four AND circuits which receives the four bits $N_1$ through $N_4$ of a note code supplied by the latch circuit 52, respectively. The signal A is applied through an OR circuit 21 to the AND circuits of the time division circuit 22. Accordingly, in the first half of one time slot, the note code $N_1$-$N_4$ is selected and supplied to the selector 24.

The selector 24 has four AND circuits corresponding to the four bits $N_1$-$N_4$ of a note code outputted by the time division circuit 22. The output of an OR circuit 53 in the lower key range detection circuit 23 is applied to the remaining input terminals of the AND circuits of the selector 24. A decoder 54 in the lower key range detection circuit 23 receives a code $N_4$, $B_1$, $B_2$, $B_3$ from the latch circuit 52, and provides decode outputs corresponding to five semi-octave ranges C2, C#2–F#2, G2–C3, C#3–F#3 and G3–C4 in the lower key range. However, when the code $N_4$-$B_3$ is for the higher key range C#4–C7, no decode output is provided by the decoder 54. A decode output concerning two octaves C2–C4 is applied to an OR circuit 55, the output of which is applied to one input terminal of an AND circuit 56. Applied to the other input terminal is the key range division mode selection signal SP from the latch circuit 52. The output of the AND circuit 56 is applied through the OR circuit 53 to the AND circuits in the selector 24.

Accordingly, in the key range division mode (SP being at "1") the output of the OR circuit 53 is raised to "1" in the time slot in which the key code $N_{1\text{-}B3}$ of the lower key range (C2–C4) is supplied, and the selector 24 is placed in selectable state.

A decode output concerning one and half octaves C2–F#3 is applied to an OR circuit 57, the output of which is applied to an AND circuit 58. A decode output concerning one octave C2–C3 is applied to an OR circuit, the output of which is applied to an AND circuit 60. The fngfinger chord function selection signal FC of the automatic bass chord performance is applied to the AND circuit 58, and the single finger function selection signal SF is applied to the AND circuit 60. The outputs of these AND circuits 58 and 60 are applied through the OR circuit 53 to the selector 24. Accordingly, the selector 24 is placed in selectable stable both in the time slot in which the key code of the key range C2–F3 is supplied in the case where the finger chord function has been selected, and in the time slot in which the key code of the key range C2–C3 is supplied in the case where the single finger function has been selected.

The lowest tone detection circuit 20 includes a memory circuit (a delay flip-flop 61). The memory circuit (61) is cleared at the start of the key depression detection scanning cycle in the key coder 14. That is, the signal $X_Q$ synchronous with the state $S_0$ is selected by an AND circuit 62 in the first half of the time slot with the aid of the signal A, and is then inverted by an inverter 63, so that the self-holding AND circuit 64 of the delay flip-flop 61 is disabled. Thus, the content of the delay flip-flop 61 is cleared.

The note code $N_1$-$N_4$ selected through the time division circuit 22 and the selector 24 is applied to a key code processing unit 65 for automatic bass chord, and to an OR circuit 66. When the key code $N_1$-$B_3$ is supplied, one of the bits of the note code $N_1$-$N_4$ is at "1" at all times, and therefore the output of the OR circuit 66 is set to "1". This output of the OR circuit 66 is loaded through an OR circuit 67 into the delay flip-flop 61, and is applied to one input terminal of an AND circuit 68, to theother input terminal of which a signal obtained by inverting the output of the delay flip-flop 61 by an inverter 69 is applied.

Figure 6:
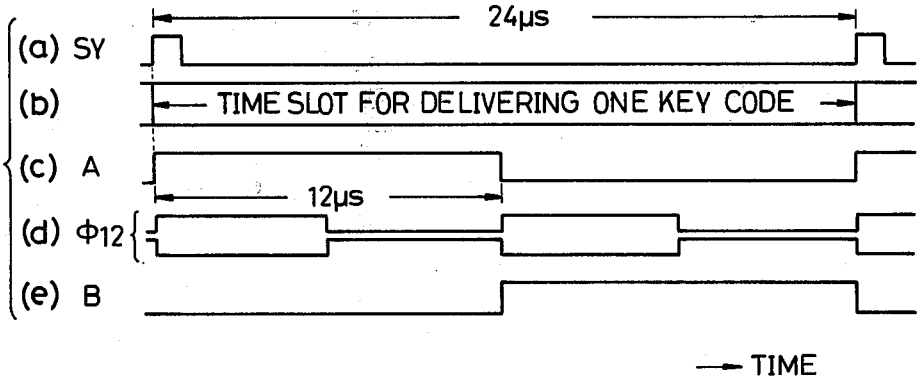
FIG. 6 is a timing chart indicating the relations in time between various signals in FIG. 5.

When a key code $N_1$-$B_3$ is supplied initially in one key depression scanning cycle and it is of the lower key range, the note code $N_1$-$N_4$ passes through the time division circuit 22 and the selector 24 in the first half of the key code's delivery time slot, and the output of the OR circuit is set to "1". In this operation, the output of the delay flip-flop 61 is at "0" as the delay flip-flop 61 has been cleared at the beginning of the cycle. Therefore, the output of the inverter 69 is at "1". Accordingly, when the output "1" of the OR circuit 66 is applied to the AND circuit 68, the AND condition of the AND circuit 68 is established. Since the delay flip-flop 61 is driven by the clock pulse $\phi_{12}$ having a period of 12 μs the output of the delay flip-flop 61 is set to "1" in the second half of the initial key code's delivery time slot. This output "1" is self-held by means of the AND circuit 64 and the OR circuit 67. Accordingly, only when a key code $N_1$-$B_3$ is firstly supplied in one key depression detection scan, the output of the AND circuit 68 is raised to "1" in the first half of that time slot. As was described before, the key depression scan in the key coder 14 is carried out starting with the lowest tone, and therefore the key code $N_1$-$B_3$ supplied (detected) first in the scanning cycle is for the lowest tone. Thus, the output of the AND circuit 68 is raised to "1" only in the first half of the delivery time slot of the key code $N_1$-$B_3$ of the lowest tone. The output "1" of the AND circuit 68 is applied to one input terminal of an AND circuit 70, to the other input terminal of which the key range division mode selection signal SP is applied. Thus, the output "1" of the AND circuit 68 is passed through the AND circuit 70 to a delay flip-flop 71 only in the key range division mode. After being delayed by 12 μs with the aid of the clock pulse $\phi_{12}$, the signal applied to the delay flip-flop 71 is outputted. Therefore, the output of the delay flip-flop 71 is raised to "1" in the second half (12 μs) of the delivery time slot of the lowest tone key code. The output "1" of the delay flip-flop 71 is applied as the signal B to the OR circuit 21 thereby to enable the AND circuits in the time division circuit 22. That is, the signal B is provided only in the second half of the delivery time slot of the lowest tone key code. If it is assumed that one time slot indicated in the part (b) of FIG. 6 is the delivery time slot of the lowest tone key code, then the signal B is provided as in the part (e) of FIG. 6.

The note code $N_1$-$N_4$ passed through the time division circuit 22 and the selector 24, and the block code $B_1$, $B_2$ required for discriminating the lower key range (the octaves C2–C4 can be discriminated by using the data $B_1$ and $B_2$ as is apparent from Table 1) are supplied to a key code processing unit 65 provided for automatic bass chords in the key code processing circuit 25. In the case of the key range division mode (SP), the key code processing unit 65 processes nothing, and merely passes the input key code $N_1$-$B_2$ as it is. In the case where the automatic bass chord performance finger chord function is selected, the key code processing unit 65 passes the input key code $N_1$-$B_2$ as it is, and outputs it as a key code LKC for the automatic chord. Furthermore, the key code processing unit 65 stores the input key code $N_1$-$B_2$ temporarily, and according to this storage, carries out processes for automatic bass chord performance, such as a chord name detection and a process fo generating an automatic bass key code PKC. In the case where the automatic bass chord performance single finger function is selected, the key code processing 65 stores the input key code $N_1$-$B_3$ temporarily (without passing it), and according to this storage, carries out a process for generating the automatic chord key code LKC and a process for generating the automatic bass key code PKC.

In other words, the automatic bass chord key code processing unit 65 passes the input key code $N_1$-$B_2$ as it is upon application of a through signal TH, and stores the input key code $N_1$-$B_2$ temporarily upon application of a memory signal M, to carry out the processes for the automatic bass chord. The through signal TH isprovided by an AND circuit 73. The output of an OR circuit 72 in the lower key range detection circuit 23, and the output of the OR circuit 21, which is applied to the time division circuit 22, are applied to the AND circuit 73. Thus, when a key code $N_1$-$B_2$ in a predetermined lower key range (C2–C4, or C2–F#3) is supplied in the key range division mode (SP) or in the finger chord function (FC), an AND circuit 56 or 58 is operated, and the through signal TH is supplied by the AND circuit 73 in synchronization with the timing at which the key code $N_1$-$B_2$ is selected by the time division circuit 22 and the selector 24.

Memory signal M is produced by an OR circuit 74 in the lower key range detection circuit 23. The outputs of the AND circuits 58 and 60 are applied to the OR circuit 74. Accordingly, when in the case of the finger chord function (FC) or the signal finger function (SF), a key code $N_1$-$B_2$ in a predetermined lower key range (C2–F#3, or C2–C3) is supplied, the AND circuit 58 or 60 is operated, so that the memory signal M is supplied through the OR circuit 74.

As is apparent from the above description, in the case of the key range division mode, no memory signal M is produced, and therefore the automatic bass chord key code processing unit 65 is not used at all, and merely the input key code $N_1$-$B_2$ passes therethrough. The key code $N_1$-$B_2$ thus passed is applied to an adder 75. In the case of the finger chord function or the single finger function, an interval numerical data SD is supplied to the adder 75 by the key code processing unit 65, as a result of which the automatic chord key code LKC and the automatic bass key code PKC is formed. However, in the case of the key range division mode, the interval numerical data SD is not supplied, and the key code $N_1$-$B_2$, in principle, merely passes through the adder 75. However, it should be noted that if octave-up switch 76 for the accompaniment tone color (or lower keyboard tone color) system is tuned on, addition for one octave-up is carried out by the adder 75 in the process time for the accompaniment tone color system (i.e., in the first half of the time slot).

When the octave-up switch 76 is turned on, a signal "1" is supplied through the switch 76 to one input terminal of an AND circuit 77, to the other input terminal of which the output of an AND circuit 78 is applied. The output of the OR circuit 72 in the lower key range detection circuit 23, and the signal A synchronous with the first half of the time slot are applied to the AND circuit 78. The output signal of the AND circuit 77 is added to the bit $B_1$ of the key code $N_1$-$B_2$ in the adder 75. As is clear from the above-described Table 1, the bit $B_1$ corresponds to one octave. Therefore, if one is added oto the bit $B_1$, then the key code $N_1$-$B_2$ outputted by the adder 75 is the adta which is obtained by increasing the octave of the key represented by the input key code $N_1$-$B_2$ by the one octave.

This addition for one octave-up is carried out in the first half of the time slot, i.e., in the process time for the accompaniment tone color (or lower keyboard tone color) system key code, in the case of the key range division mode (SP) or the finger chord function (FC). The key code $N_1$-$B_2$, subjected one octave-up, outputted by the adder 75 is supplied, as an accompaniment tone color (or lower keyboard tone color) system key code LKC, to the auxiliary channel processor 18 (FIG. 1). In this operation, the output "1" of the AND circuit 78 is supplied, as an accompaniment tone color (or lower keyboard tone color) system key-on signal LK, to the auxiliary channel processor 18 through an OR circuit 79.

In the auxiliary channel processor 18, only the key code LKC supplied together with the key-on signal LK is handled as an effective one. Accordingly, even if a key code $N_1$-$B_2$ is supplied by the adder 75 in the second half of the time slot, this key code $N_1$-$B_2$ is not handled as an effective one in the auxiliary channel processor 18, because no key-on signal LK is provided.

On the other hand, the output of the adder 75 is applied to a bass register 26. As the bass register 26 is placed in loading state by the output "1" of an OR circuit 80, the key code $N_1$-$B_2$, subjected to one octave-up, outputted in the first half of the time slot is not loaded into the bass register 26.

The signal B used for setting the process time of the bass tone color system of the lowest tone is applied to the OR circuit 80. Accordingly, only when the signal B is provided, the bass register 26 is placed in loading state, and therefore the lowest tone key code $N_1$-$B_2$ passed through the time division circuit 22, the selector 24, the key code processing unit 65 and the adder 75 is loaded into the bass register 26 in the second half of the time slot. The addition for one octave-up in the adder 75 is carried out only in the first half of the tmetime slot, and therefore the key code $N_1$-$B_2$ loaded in the bass register 26 has not been subjected to octave change.

The key code $N_1$-$B_2$ stored in the bass register 26 is supplied, as the bass key code PKC, to the bass tone generator 19 (FIG. 1). A bass key-on signal forming circuit 81 operates to provide a bass key-on signal PK having a predetermined time width with the aid of the output of the OR circuit 80. In the case of the key range division mode (SP), the circuit 81 causes the bass key-on signal PK to be maintained at "1" during the lowest tone key depression. The key depression and the key release of the lowest tone are decided as follows: If the output of the OR circuit 80 is raised to "1" even once during one generation interval of the signal $X_1$, it is decided that the key is being depressed. If the output of the OR circuit 80 is not raised to "1" at all during one generation interval of the signal $X_1$, it is decided that the key has been released. In the bass tone generator 19, a bass tone corresponding to the lowest tone key code PKC stored in the bass register 26 is generated for the period in which the keyon signal PK is maintained at "1".

As is clear from the above description, in the case of the key range division mode (SP), a key code $N_1$-$B_2$ of the lower key range (C2–C4) is processed in the first half of the delivery time slot of the key code (for instance, the one octave-up process being carried out), and a lower key range musical tone is generated by the auxiliary tone generator 13 according to the assignment by the auxiliary channel process 13. The key code $N_1$-$B_2$ of the lowest tone in the lower key range is processed in the second half of the time slot, and the muscial tone of the lowest tone is generated by the bass tone generator 19.

In the case of the finger chord function or the single finger function, an automatic bass key-on signal APK is provided by the automatic bass chord key code processing unit 65, and it is applied through the OR circuit 80 to the bass register 26 and the bass key-on signal forming circuit 81. In the case of the single finger function, an automatic chord key-on signal ALK is provided by the key code processing unit 65, and it is applied, as the key-on signal LK, to the auxiliary channel processor 18 through an OR circuit 79.

In the above-described example, the lowest tone of the lower key range is generated with the particular tone color (for instance, the bass tone color); however, the highest tone of the lower key range, or the lowest tone of the higher key range, or the highest tone of the higher key range may be generated with a particular tone color.

Furthermore, in the above-described example, the key range is divided into the higher key range and the lower key range between notes C4 and C#4; however, it should be noted that the invention is not limited thereto or thereby. In the example, the circuits for the automatic bass chord performance (finger chord function and single finger function) are provided in combination; however, they may be eliminated.

In the above-described example, the process for the accompaniment tone color (or lower keyboard tone color) system is carried out in the first half of the time slot, and the process for the bass tone color system is carried out in the second half of the time slot; however, the former process may be carried out in the second half of the time slot, and the latter process may be carried out in the first half.

The process for the accompaniment tone color system is carried out in the first half of the time slot even for other than the lowest tone; however, the circuitry may be so designed that the time slot is used by dividing it into two parts only for the lowest tone (or highest tone), and the time slot is used, in its entirety, for other tones.

What is claimed is:

1. An electronic musical instrument comprising:

key switches corresponding to keys;

depressed key detection means for detecting on-off states if said key switches to sequentially deliver key data of depressed keys in respective time slots of a scanning cycle in which keys are scanned in the order of corresponding note pitch;

specific key detection means for detecting the specific time slot in which key data of the note of the first key in a predetermined priority order among the depressed keys is delivered;

a processing circuit for using one half of the specific time slot detected by said specific key detection means as a first processing time and the other half of said specific time slot detected by said specific key detection means as a second processing time, and for applying different processing to the key data of said first key respectively during said first and second processing times;

a first musical tone generation circuit for generating musical tones in response to the key data supplied during said first processing time; and a second musical tone generation circuit for generating musical tones in response to the key data supplied during said second processing time.

2. An electronic musical instrument as defined in claim 1 wherein said specific key detection means is a circuit which detects the specific time slot to which the first key data in the cycle of sequential key data is delivered by said depressed key detection means.

3. In an electronic muscial instrument having a single keyboard with keys separated into a lower key range and a higher key range in accordance with corresponding note pitch, and having a key coder which scans the keyboard and sequentially provides, during time slots of each scanning cycle, key codes identifying depressed keys, the improvement comprising:

key range detection means for detecting from the key codes provided in each time slot the key range containing the corresponding depressed key, and for gating out the key codes for keys in a certain one of said key ranges during one portion only of each of the corresponding time slots, said one portion being less than the entire time slot, time shared tone generator means, connected to said key range detection means, for providing musical tones corresponding to each of the key codes gated out in said one portion of said corresponding time slots, priority key detection means, cooperating with said key range detection means, for determining the one time slot containing the key code for a key of certain predetermined priority amongst the depressed keys in said one key range, and for gating out that key code during the remaining portion of the time slot containing that key code, and register and monophonic tone generator means, connected to said priority key detection means and responsive only to a key code gated out in said time slot remaining portion, for generating a musical tone corresponding thereto.

4. An electronic musical instrument according to claim 3 further comprising:

a second time shared tone generator having a tone color different from the other time shared tone generator, for providing musical tones correspondong to the key codes provided during time slots which are identified by said key range detection means as being assigned to key codes for keys not in said certain one of said key ranges.

5. An electronic musical instrument comprising:

key switches corresponding to keys arranged in a certain order;

depressed key detection means for detecting on-off states of said key switches to deliver, during sequential time slots of a scanning cycle, key data of depressed keys in the order of arrangement of said keys;

specific key detection means for detecting the one time slot in which key data of the specific key of a predetermined priority among the depressed keys is delivered;

gate means for gating out said delivered key data of depressed keys from said depressed key detection means only during one portion of each of said time slots, said one portion being less than the whole of said time slot, and for gating out, during the remaining portion of only said one time slot detected by said specific key detection means, the key data of said specific key;

a processing unit for processing the key data gated out of said gate means during said one portion of said each time slot to output it as first key data, and processing the key data of the specific key gated out of said gate means during said remaining portion of said only time slot detected by said specific key detection means to output it as second key data;

a first musical tone generation circuit for generating musical tones in response to said first key data; and a second musical tone generation circuit for generating musical tones in response to said second key data.

6. An electronic musical instrument as defined in claim 5 wherein said specific key detection means is a circuit which detects a time slot to which the first key data in said scanning cycle is delivered.

7. An electronic musical instrument as defined in claim 5 wherein said processing unit processes the key data so that octave data contained in the key data present during said one portion of each time slot is different from octave data contained in the key data present during said remaining portion of each time slot.

8. An electronic musical instrument as defined in claim 5 further comprising an additional musical tone generation circuit, and and wherein said gate means gates out only key data belonging to a predetermined key range and said first musical tone generation circuit generates tones of said predetermined key range, tones not belonging to said predetermined key range being generated by said additional musical tone generation circuit.

9. An electronic musical instrument according to claim 8 wherein said keys are arranged in ascending order of pitch of the corresponding musical notes selected by said keys, said keys being separated into a lower key range and a higher key range, said gate means gating out only key data for depressed keys in said lower key range.

* * * * *